US005540462A

United States Patent [19]

Laursdahl et al.

[11] Patent Number: 5,540,462

[45] Date of Patent: Jul. 30, 1996

[54] COVER DEVICE FOR SUBSEQUENT MOUNTING ON SOFTBOUND BOOKS

[76] Inventors: Helle Laursdahl, Aalundsvej 17, DK-8250 Egaa, Denmark; Nis Oellgaard, Heibergsgade 1 C, DK-8000 Aarhus C, Denmark

[21] Appl. No.: 387,784

[22] PCT Filed: Aug. 16, 1993

[86] PCT No.: PCT/DK93/00265

§ 371 Date: Feb. 21, 1995

§ 102(e) Date: Feb. 21, 1995

[87] PCT Pub. No.: WO94/04375

PCT Pub. Date: Mar. 3, 1994

[30] Foreign Application Priority Data

Aug. 20, 1992 [DK] Denmark ..... 1033/92

[51] Int. Cl.[6] ..... B42D 1/00

[52] U.S. Cl. ..... 281/20; 281/29

[58] Field of Search ..... 281/18, 20, 19.1, 281/15.1, 21.1, 51, 29, 36, 37

[56] References Cited

U.S. PATENT DOCUMENTS

| | | | |
|---|---|---|---|
| 2,732,842 | 1/1956 | Loudon | 129/1 |
| 3,940,904 | 3/1976 | McGuire et al. | 281/18 X |
| 4,083,582 | 4/1978 | Villafann | 281/70 |
| 4,630,843 | 12/1986 | Willat | 281/30 |
| 4,932,679 | 6/1990 | Mayer et al. | 281/18 |
| 5,108,130 | 4/1992 | Hansen | 281/18 |
| 5,388,861 | 2/1995 | Reiter | 281/20 X |

FOREIGN PATENT DOCUMENTS

| | | | |
|---|---|---|---|
| 19606 | 11/1980 | European Pat. Off. | 281/18 |
| 0292412 | 5/1988 | European Pat. Off. . | |
| 0454906 | 12/1990 | European Pat. Off. . | |
| 2513942 | 4/1983 | France | 281/18 |
| 7535159 | 11/1975 | Germany . | |
| 3441050 | 6/1985 | Germany . | |

*Primary Examiner*—Willmon Fridie, Jr.
*Attorney, Agent, or Firm*—Antonelli, Terry, Stout & Kraus

[57] ABSTRACT

By a cover device (6, 30) for subsequent mounting on paperbacks (2) for instance telephone books, and comprising a first cover part (8, 32) being adapted to be permanently secured by gluing along a longitudinal edge of a cover side member of the paperback (2), a connecting part (10, 36) adapted to stretch across an open side (20) of the paperback (2) opposite the back thereof, and a second cover part (12, 40) adapted to be releasably connected to a second cover side member of the paperback (2), said second cover part (12, 40) in a distance from said connecting part (10, 36) being provided with connecting means (24, 42) for effecting said releasably connection of the second cover part (12, 40) to said second cover side member of the paperback (2), that said cover device (6, 30) being manufactured from deformation-resistant material being capable of taking up or transmitting shearing forces, as said cover device being adapted to stretch across a lowermost section of said open side (20) of the paperback (2) and to be mounted, so that a lowermost edge of said first cover part (8, 32) mainly flushes with a lowermost edge of a short side of said cover side member of the paperback (2).

18 Claims, 3 Drawing Sheets

COVER DEVICE FOR SUBSEQUENT MOUNTING ON SOFTBOUND BOOKS

FIELD OF THE INVENTION

Figure 1A:
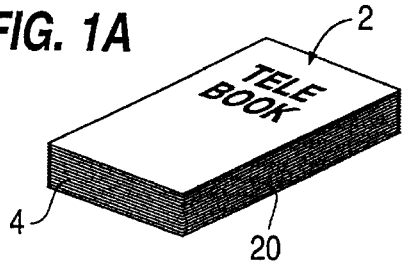

The invention relates to a cover device for subsequent mounting on paperbacks for instance phone books,

DESCRIPTION OF THE PRIOR ART

Books without stiff cover, that is paperbacks, normally can not be placed standing up, that is supported on a narrow side egde on a surface or a book shelf without a suitable side support, for instance a book end or a neighboring book. If a suitable separate side support is not used a paperback normally will "collapse", if a neighboring book is taken out from the shelf, the book may be damaged permanently; and it is becomes difficult to replace the neighoring book. In particular this problem concerns larger paperbacks, for instance telephone books or similar large "soft" books or booklets.

The described problem may of course be solved by a kind of binding, where the book is provided with a cover with a back and a stiff front and back side member. This could be be obtained by means of a traditional bookbinding, or by means of a loose binder or cover, which may be mounted by the user, and which possibly could be reused for new or other books; but this would however be a rather expensive solution.

SUMMARY OF THE INVENTION

The purpose of the invention is to provide a cover device of the type described in the above and by means of which a good support of paperbacks, in particular of the telephone book type, may be obtained in a simple and cheap manner.

The cover device according to the invention is distinctive in that said second cover part in a distance from said connecting part being provided with connecting means for effecting said releasably connection of the second cover part to said second cover side member of the paperback, and that said cover device being manufactured from deformation-resistant material being capable of taking up or transmitting shearing forces. In a simple and cheap manner a cover device is hereby obtained, which at subsequent mounting may provide a good support of a paperback, for instance a telephone book, and of which paperback said second cover part, when it is not secured to said second cover side member of the book (front page), also—as a further advantage—may be used as put in book mark.

In a preferred embodiment the cover device according to the invention is such provided, that said first cower part is adapted to be secured to an outer side of said cower side member of the paperback, and that the second cover part being adapted to be temporarily connected to an outer side of the front cover side member of the paperback.

Preferably a cover device according to the invention is furthermore adapted to stretch across a lowermost section of said open side of the paperback and to be mounted, so that a lowermost edge of the first cover part is mainly flush with a lowermost edge of a short side of said cover side member of the paperback.

The cover device according to the invention may advantageously be so provided, that the second cover part is provided with decreasing height in the direction away from the connecting part. And preferably the cover device is further so provided, that the second cover part mainly is triangular, that is provided with sides, which in the direction opposite the connecting part stretches towards connecting means placed mainly on level with the center of the connecting part.

To make a correct placement easier of the parts of the connecting means adapted to be secured permanently to the second cover side member of the paperback is temporarily secured to the second cover part. It becomes extra easy to place this correctly dependent on the thickness of the book in question.

In a particular simple manner the cover device according to the invention is so provided, that the connecting means for connecting the second cover part to the the second cover side member of the paperback consist of tape- or button-shaped velcro locks, of which the respective basis pans preferably are self-adhesive.

The invention furthermore relates to a method for manufacturing a cover device according to the invention and where the cover device is manufactured from a length of laminate consisting of an impregnated backing paper and a plastic sheet member, which method is distinctive in, that said plastic sheet member at mutually spaced longitudinal zones along opposite edges being provided with an adhesive coating on the side facing the backing paper, said zones stretch along opposite edges of the plastic sheet member, that said first cover part is punched out from one of said longitudinal edge zones, that said connecting means of the second cover part being punched out from the opposite edge zone, and that the connecting part and the second cover part are made from a middle zone of the plastic sheet member, which middle zone is without adhesive coating.

Figure 1B:
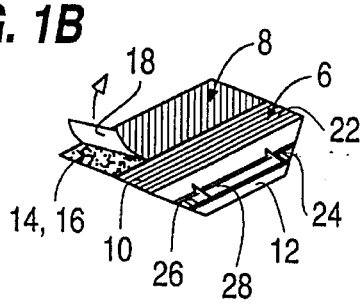
Figure 2:
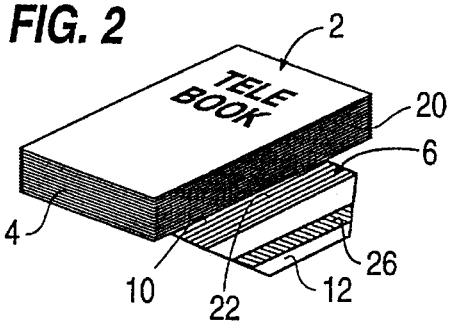
Figure 3:
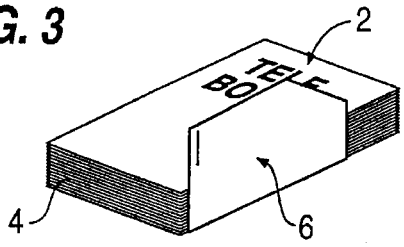
Figure 4:
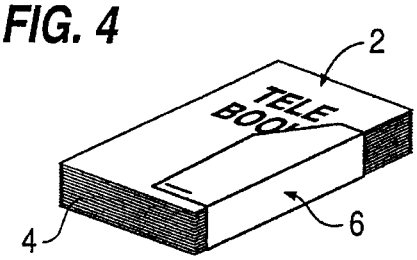

The invention is described in the following with reference to the drawing, in which:

FIGS. 1A and 1B show a telephone book and an embodiment for a cover device, respectively according to the invention, FIGS. 2–4 show, how the cover device shown in FIG. 1B is mounted on and is adjusted to the telephone book shown in FIG. 1A.

Figure 5:
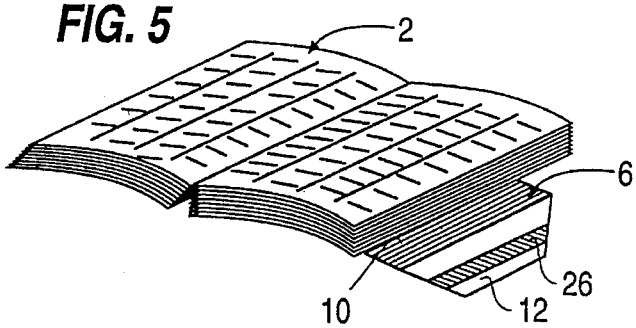
Figure 6:
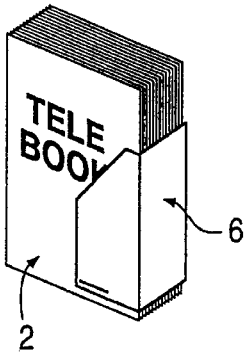
Figure 7:
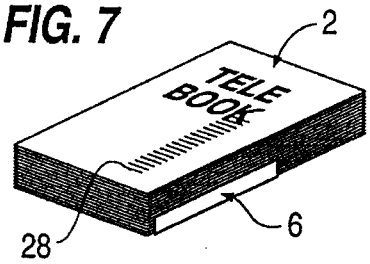
Figure 8:
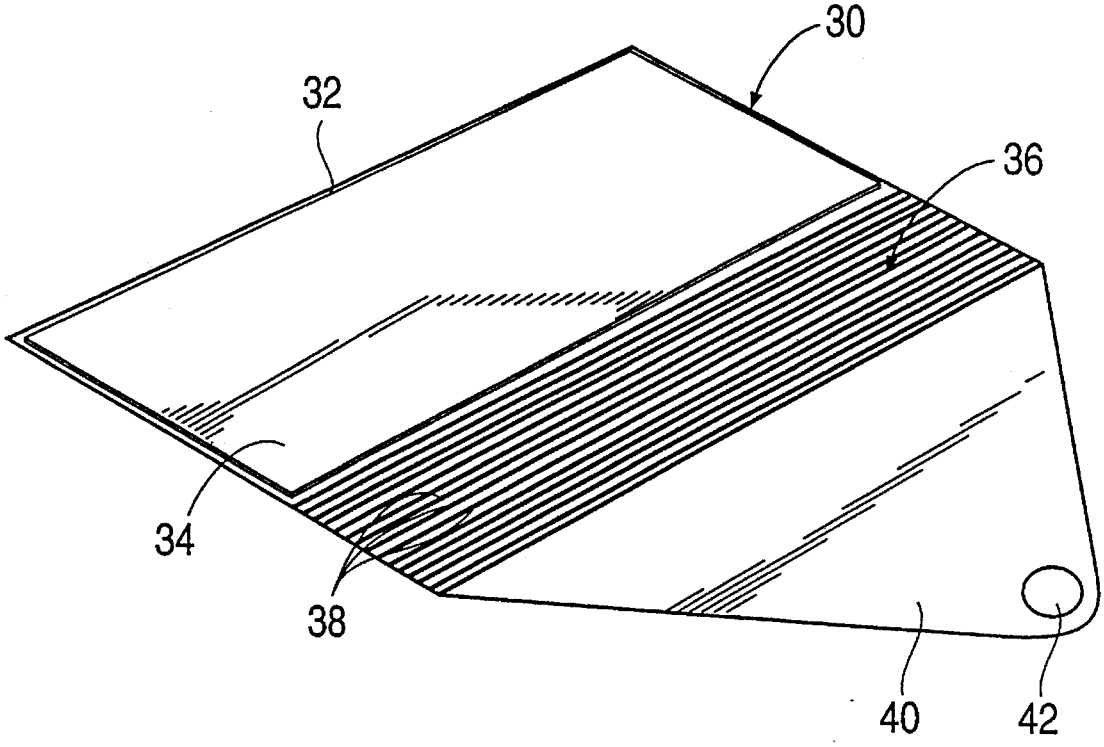
Figure 9:
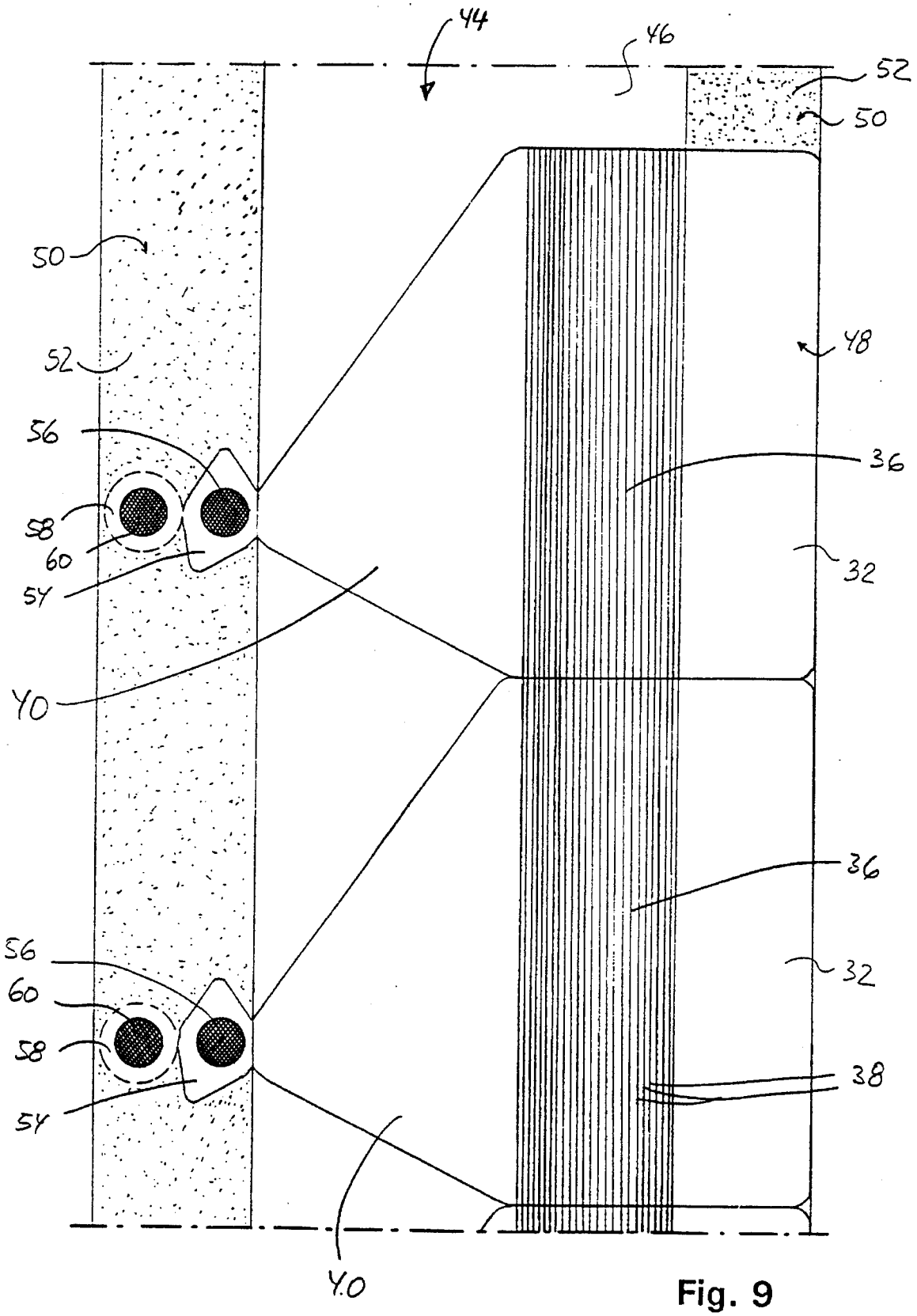

FIG. 6 shows, how a cover device according to the invention may be used as a support, by way of: example, for a telephone book, FIGS. 5 and 7 show, how a cover device according to the invention may be used as put in book mark, by way of example, for a telephone book, FIG. 8 shows an other embodiment for a cover device according to the invention, while FIG. 9 shows a preferred embodiment for a cover device manufactured in accordance to the method according to the invention.

The book shown in FIG. 1A is an ordinary paperback telephone book 2 of A4-format, that is a rather large and relative "soft" book, which not without a side support can be placed in vertical opright position on a short side edge 4 of the telephone book 2.

The cover device 6 shown in FIG. 1B is manufactured from thin plate material, for instance a suitable plastic sheet, and consists of a rectangular rearmost cover part 8, a connecting part 10 and a front cover part 12. The cover part 8 is on an internal side 14 provided with an adhesive coating 16, which temporarily is covered of a suiteable impregnated backing paper 18, which as indicated is adapted to be pulled of, before the cover part 8—as shown in FIG. 2—is mounted on a rearmost cover side member of the telephone book 2, so that the cover part 8 flushes with the short side edge 4 and with the side edge of a narrow side 20 of the telephone book 2—opposite the back thereof.

The connecting part 10 is—as most clearly shown in FIG. 2—provided with folding lines or folding recesses 22 adapted to stretch parallel with said side edge of the narrow side 20, so that the "used width" of the connecting part 10 easily may be adjusted in accordance to the thickness of for instance the telephone book 2 (FIGS. 3–4).

The front cover part 12 is in a distance from the connecting part 10 provided with a tape-shaped velcro lock (american zipper) 24, the one part 26 of which (FIG. 2) in advance is secured permanently to the cover part 12, and the second part 28 of which (FIG. 7)—in order to make easier the mounting of the cover device 6—is temporarily secured to said in advance mounted second part of the velcro lock 24 (FIG. 1B). This means, that the cover device 6—as a whole—is easy to mount sufficiently thight around the lower, external corner of the closed telephone book 2, which thereafter as shown in FIG. 6—now without tendency to tumble over—may be placed in vertical opright position supported on the short side edge 4.

When the telephone book 2 is used for its purpose, the cover device 6 may be used as a put in book mark (FIGS. 5 and 7).

In a preferred embodiment a cover device 30—as shown in FIG. 8—is manufactured from relatively stiff flexible plastic sheet material, which furthermore may be transparent. A cover part 32 is—as earlier described—provided with a self-adhesive coating with a temporary backing paper 34. Also a connecting part 36 is—as earlier described—provided with folding lines or recesses 36; on the other hand a front cover part 40 is now shaped triangular and provided with a circular velcro lock 42 at the tip end of the cover part 40.

Alternatively the cover part 8 may be adapted to be secured to the book by means of any suitable adhesive means or fastening means, for instance staples.

Preferably the cover part 8 is adapted to be secured external on the rearmost cover side member of the telephone book 2; but of course the cover part 8 may also be adapted to be secured internal on the rearmost cover side member of the book. The same applies for the cover part 12, which may be adapted to be secured temporarily either to the internal side or to the external side of the front cover side member of the telephone book 2.

The temporary fastening of the cover part 12—which in the shown embodiments are made by velcro locks 24 or 42—may possibly be provided as another form of relock system, for instance a snap fastener or a magnetic catch.

The cover device described and defined may—within the scope of the invention - have any suitably embodiment and may be manufactured from any suitable material, when only the main aspect of the invention is considered, namely that it is possible to connect for instance rearmost cover side member and front cover side member of a paperback by means of a cover device adapted to taking up or to transmit the shearing forces, which might occur between the respective cover side members of the book.

The cover device according to the invention is preferably manufactured by the stated preferred method, that is—as shown in FIG. 9—from a length of laminate 44 consisting of an impregnated backing paper 46 and a plastic sheet member 48, which on the side facing the backing paper 46 with mutual distance is provided with longitudinal zones 50 of an adhesive coating 52.

With reference to FIG. 8 the cover device consists of a flexible plastic sheet member 48 and comprises a cover part 32, which by the method according to the invention is connected with adhesive coating 52, as this only temporarily fixes to the impregnated backing paper 46, a connecting part 36 being provided with folding lines or folding recesses 38, which are made by means of less high cutting rollers of a roller punch currently punching out the whole cover device. This cover device furthermore comprises a front cover part 40 being connected with a carrying part 54 for a velcro lock member 56, said carrying part 54 is adapted to be bend around and to be glued onto the internal side of the tip part of the front cover part 40. A separate circular carrying part 58 for a velcro lock member 60 which is also provided with an adhesive coating, is punched out at the same as the plastic sheet member 48.

The separate carrying part 58 is adapted to be secured to the front cover page of a book, and it is mounted in a simple manner by securing temporarily its velcro lock member 60 to the velcro lock member 56 of the cover part 40, so that the carrying part 58 automatically is secured in a correct position, when the cover part 40 and the connecting part 36, respectively, are folded thightly around the open side egde of a certain book, for instance a telephone book.

It will be within the scope of the invention, that the outmost tip end of front cover part 12, 40 on internal side is provided with an adhesive coating of the type, which permanently or at least several times allowing the front cover part 12, 40 to be secured to the front cover side member of the book. And a such adhesive coating may be applyed on internal side of the front cover part 40 in accordance to the stated method, as one of said edge zones of the adhesive coating just may consist of a such adhesive coating, which may replace the said velcro lock members 56 and 60 with belonging carrying parts 54 and 58, that is that the cover device may be manufactured from a similar more narrow length-shaped laminate, where each of the longitudinal edge zones 50 are provided with different types of adhesive coating.

We claim:

1. A device for mounting on a book to make the book sufficiently rigid to stand the book vertically upward on an end thereof comprising:

a first cover part having a fastening means to be attached to a first cover side member of the book;

a second cover part having a connecting means to be attached to a second cover side member of the book; and a connecting part extending between the first and second cover parts for mounting in a position opposed to a narrow side of the book disposed between the first and second cover side members with the connecting part including means for stretching a width of the connecting part parallel to the narrow side of the book so as to vary the width of the connecting part to match a width of the narrow side of the book when the first and second cover parts are attached to the first and second cover side members respectively.

2. A device in accordance with claim 1 wherein:

the means for stretching comprises folding lines.

3. A device in accordance with claim 1 wherein:

the means for stretching comprises folding recesses.

4. A device in accordance with claim 1 wherein:

the fastening means is to be attached to an outer side of the first cover side member of a rear side of the book and the connecting means is to be attached to an outer side of the second cover side member of the front side of the book.

5. A device accordance with claim 1 wherein:

the fastening means as to be attached to the first cover side member to position a lower most edge of the first cover part flush with a lower most edge of a first cover side member of a rear side of the book.

6. A device in accordance with claim 1 wherein:

the second cover part decreases in height measured parallel to a height of the book when the device is attached to the book.

7. A device in accordance with claim 2 wherein:

the second cover part decreases in height measured parallel to a height of the book when the device is attached to the book.

8. A device in accordance with claim 6 wherein:

the decrease in height of the second cover part is in a triangular shape with an apex of the triangular shape being opposed to a center of the intermediate part.

9. A device in accordance with claim 7 wherein:

the decrease in height of the second cover part is in a triangular shape with an apex of the triangular shape being opposed to a center of the intermediate part.

10. A device in accordance with claim 3 wherein:

the second cover part decreases in height measured parallel to a height of the book when the device is attached to the book.

11. A device in accordance with claim 10 wherein:

the decrease in height of the second cover part is in a triangular shape with an apex of the triangular shape being opposed to a center of the intermediate part.

12. A device in accordance with claim 4 wherein:

the second cover part decreases in height measured parallel to a height of the book when the device is attached to the book.

13. A device in accordance with claim 12 wherein:

the decrease in height of the second cover part is in a triangular shape with an apex of the triangular shape being opposed to a center of the intermediate part.

14. A device in accordance with claim 5 wherein:

the second cover part decreases in height measured parallel to a height of the book when the device is attached to the book.

15. A device in accordance with claim 14 wherein:

the decrease in height of the second cover part is in a triangular shape with an apex of the triangular shape being opposed to a center of the intermediate part.

16. A device in accordance with claim 1 wherein:

the connecting means comprises a part for permanent attachment to the second cover side member which is temporarily secured to the second cover part prior to the permanent attachment to the second cover side member.

17. A device in accordance with claim 1 wherein:

the connecting means comprises a hook and eye connecting device having two parts with a first part having hooks on one side and a self-adhesive on another side and a second part having eyes on one side and a self-adhesive on another side with the hooks and eyes being temporarily attachable to each other.

18. A method of manufacturing a device for mounting on a book to make the book sufficiently rigid so to stand the book vertically upward on an end thereof having a first cover part having a fastening means to be attached to a first cover side member of the book, a second cover part having a connecting means to be attached to a second cover side member of the book, and an connecting part extending between the first and second parts for mounting in a position opposed to a narrow side of the book disposed between the first and second cover side members with the connecting part including means for stretching a width of the connecting part parallel to the narrow side of the book so as to vary the width of the connecting part to match a width of the narrow side of the book when the first and second cover parts are attached to the first and second cover side member respectively comprising:

providing a laminate having an impregnated backing paper and a plastic sheet member with spaced apart zones of an adhesive disposed on the paper extending along edges of the plastic sheet member, punching out the first cover part from one of the zones;

punching out the connecting means from another of the zones;

forming the connecting part at a side of the plastic sheet member opposite the backing paper; and forming the connecting part and the second cover part from a middle part of the plastic sheet member not having adhesive coating.

* * * * *